United States Patent [19]

Koch et al.

[11] Patent Number: 4,657,335

[45] Date of Patent: Apr. 14, 1987

[54] RADIALLY RESILIENT ELECTRICAL SOCKET

[75] Inventors: Joseph J. Koch, Mt. Clemens; Richard N. Koch, St. Clair Shores; Peter H. Vandekerkhof, Richmond, all of Mich.

[73] Assignee: K & K Stamping, Fraser, Mich.

[21] Appl. No.: 824,116

[22] Filed: Jan. 30, 1986

[51] Int. Cl.[4] ..... H01R 13/11

[52] U.S. Cl. ..... 339/256 R

[58] Field of Search ..... 339/255 RT, 256 R, 256 S, 339/256 RT

[56] References Cited

U.S. PATENT DOCUMENTS 1,833,145 11/1931 Wilhelm ..... 339/256 R
3,396,364 8/1968 Bonhomme ..... 339/217
3,470,527 9/1969 Bonhomme ..... 339/256
3,557,428 1/1971 Bonhomme ..... 29/203
3,641,483 2/1972 Bonhomme ..... 339/217 S
4,203,647 5/1980 Bonhomme ..... 339/256 R

*Primary Examiner*—Joseph H. McGlynn
*Attorney, Agent, or Firm*—Basile, Weintraub & Hanlon

[57] ABSTRACT

A barrel terminal socket is constructed by forming a sheet metal blank with uniformly spaced, parallel, longitudinal strips integrally connected at their opposite ends to transversely extending webs. The blank is then formed into a cylinder, inserted into a close-fitting cylindrical sleeve and one end of the blank is fixedly secured to the sleeve. The opposite end of the blank is then rotated relative to the sleeve through a predetermined angle and then fixedly secured in its rotated position to the sleeve.

5 Claims, 10 Drawing Figures

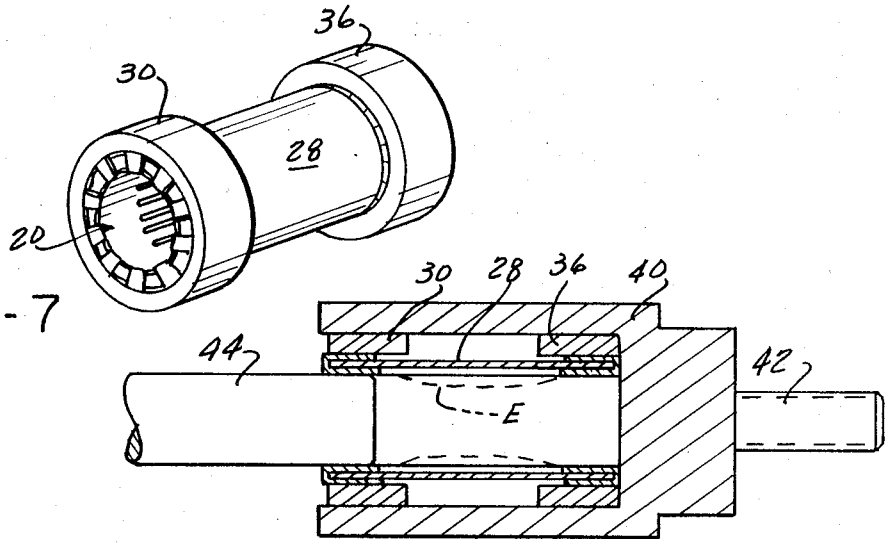
FIG-7
FIG-8
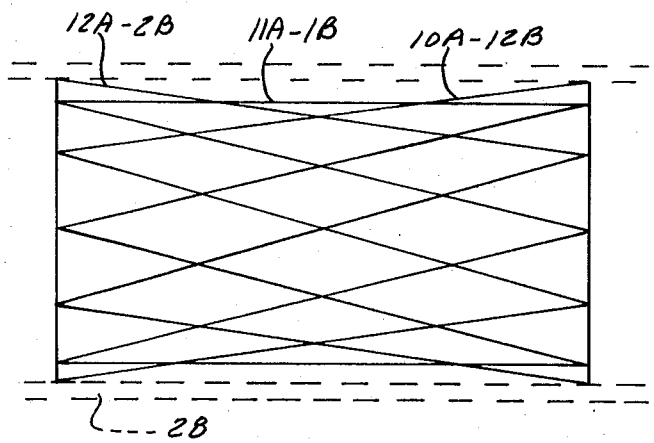
FIG-10
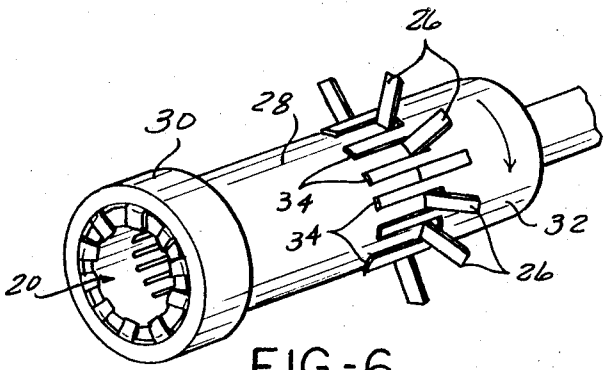
FIG-6
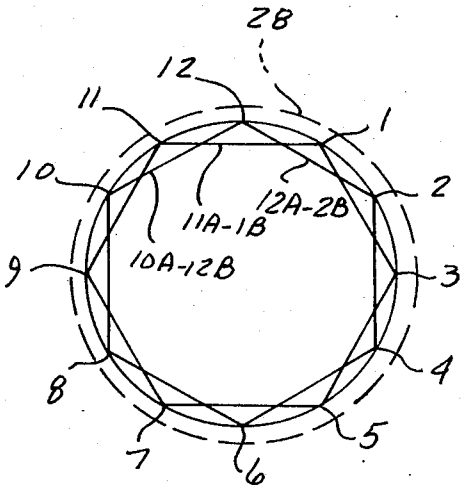
FIG-9

RADIALLY RESILIENT ELECTRICAL SOCKET

BACKGROUND OF THE INVENTION

The present invention is concerned with radially resilient electrical sockets of the type sometimes referred to as barrel terminals in which a solid, cylindrical, electrical prong is axially inserted into a socket whose interior surface is defined by a plurality of wires mounted within a cylindrical sleeve in tension between angularly offset positions at opposite ends of the sleeve. The wires lie along an axially concave surface of revolution coaxial with the axis of the cylindrical sleeve whose minimum radius is slightly less than the radius of the cylindrical prong. When the prong is inserted axially into the sleeve, the individual wires are slightly stretched and collectively exert a reasonably firm frictional grip upon the prong.

Electrical connectors of this type are well known in the prior art. These connectors are finding increasing employment, particularly in the automotive field, for such usage as connecting relatively heavy output cables to generators or alternators, for example. The frictional grip imparted by such sockets is sufficient to maintain a firm mechanical connection in the face of normal usage while accommodating relatively easy manual withdrawal or insertion of the prong into the socket, while at the same time providing adequate electrical contact area between the prong and the socket. Prior art connectors in which the radially resilient socket is defined by a plurality of wires assembled within a cylindrical sleeve to define an hourglass shaped cage of the type described above present substantial assembly problems. The connectors are not especially large, a typical sleeve may have nominal dimensions of approximately one inch in length and one-half inch in outside diameter and within such a sleeve a reasonably large number, say 12 to 15, individual wires must be located to extend between angularly displaced locations at opposite ends of the sleeve and accurately fixed in position. While various fixtures have been designed to assist in this operation, a substantial amount of manual work is involved, which substantially increases the cost of production.

The present invention is especially directed to a method and structural arrangement which enables barrel terminal sockets to be rapidly and accurately assembled with minimum reliance on manual processing.

SUMMARY OF THE INVENTION

In accordance with the present invention, the radially resilient cage of the barrel terminal socket is not constituted by individual wires, but is instead constructed from a sheet metal stamping. The initial step in the formation of the cage is the formation of a generally rectangular stamping with two continuous, transversely extending webs spaced inwardly from and parallel to the opposite end edges of the blank. Between the inner side edges of the transverse web, a plurality of uniformly spaced, parallel slots extend to define a plurality of uniformly spaced, parallel, longitudinally extending strips inwardly joined at opposite ends of the transverse webs. Other longitudinally extending slots are formed in the blank to extend inwardly from the end edges of the blank to the outer side edges of the transverse webs to form a plurality of uniformly spaced, longitudinally extending tabs projecting outwardly from each transverse web.

The blank is then formed into a cylinder with the longitudinal strips extending parallel to the axis of the now cylindrical blank. A closely fitting cylindrical sleeve is slipped coaxially around the outer periphery of the cylindrical blank, the sleeve extending axially substantially between the outer edges of the transverse webs. The mounting tabs at each end of the blank are then bent outwardly across the end edges of the sleeve into radially extending relationship to the sleeve.

A relatively tight-fitting annular ring is then axially advanced against the radially projecting tabs at one end of the sleeve and slipped over the end of the sleeve, driving the tabs at that end of the sleeve downwardly into face-to-face engagement with the outer surface of the sleeve. The fit of the annular ring is so chosen that when it is finally seated, the end of the cylindrical blank at which the ring is located is fixedly clamped to the sleeve against both axial or rotary movement relative to the sleeve.

A tool having an annular array of uniformly spaced, axially projecting teeth is then engaged with the radially projecting tabs at the opposite end of the sleeve. The teeth on the tool are so located as to project axially between the radially projecting tabs closely adjacent the outer surface of the cylindrical sleeve. When so engaged, the tool is then rotated about the axis of the cylindrical sleeve while the sleeve is held stationary to rotatively displace the engaged tabs approximately 15 to 20 degrees from their original rotative orientation relative to the sleeve. The tool is then withdrawn and a second annular ring is force fitted over the tabs and sleeve to fixedly locate this end of the blank in the rotatively offset position established by operation of the tool.

The foregoing process, when completed, finds the longitudinal strips extending generally along a straight line between angularly offset locations adjacent the opposite ends of the cylindrical sleeve. The internal envelope cooperatively defined by the longitudinal strips is a surface of revolution coaxial to the axis of the cylindrical sleeve having equal maximum radii at the points where the strips are joined to the respective webs and a somewhat smaller radius midway of the length of the strips. The minimum radius, midway between the opposite ends of the strips, is selected to be slightly less than the radius of the cylindrical connector prong which is to be inserted into the barrel terminal so that insertion of the prong requires the individual longiudinal strips to stretch slightly longitudinally to firmly frictionally grip the prong when it is seated within the terminal.

Other objects and features of the invention will become apparent by reference to the following specification and to the drawings.

IN THE DRAWINGS

FIG. 6 shows a subsequent step in the construction of the barrel terminal;

FIG. 7 is a perspective view of the finally assembled barrel of the barrel terminal;

FIG. 8 is a cross-sectional view, with certain parts broken away or ommitted, of a connector embodying the present invention; and FIGS. 9 and 10 are schematic diagrams illustrating the relationship of the longitudinal strips of the barrel terminal in their final assembled relationship.

DESCRIPTION OF THE PREFERRED EMBODIMENT

The structure of a barrel terminal socket embodying the present invention is best explained by a description of the manner in which it is manufactured.

Figure 1:
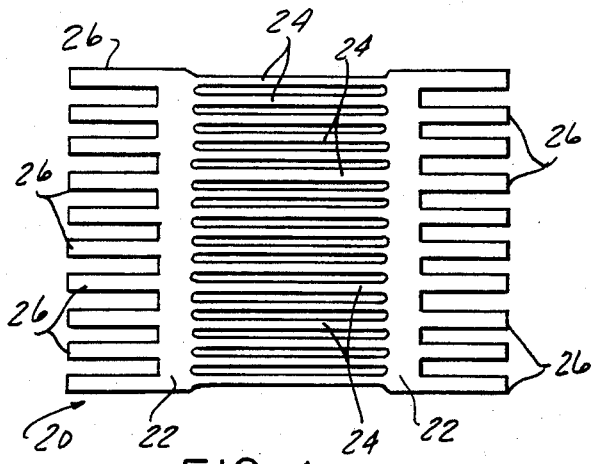
FIG. 1 is a top plan view of a flat shet metal blank employed in constructing a barrel terminal embodying the present invention.

The first step in the manufacture of the barrel terminal socket is the stamping of a blank in the form shown in FIG. 1 from a flat piece of sheet metal which preferably is a beryllium copper alloy which has both mechanical and electrical properties well adapted for this application.

Referring to FIG. 1, the blank designated generally 20 is stamped in a generally rectangular configuration and formed with a pair of spaced, parallel, transversely extending connecting web portions 22 which are integrally connected to each other by a plurality of uniformly spaced, parallel, longitudinally extending strips 24 which extend between the respective inner edges of the webs 22. A plurality of spaced, parallel tabs 26 project longitudinally outwardly from the outer edges of the respective transverse webs 22.

Figure 2:
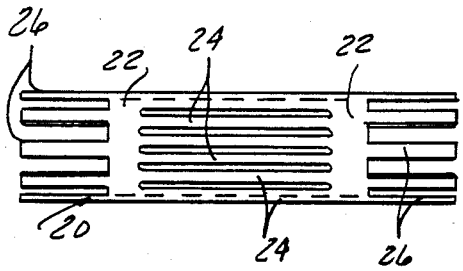
FIG. 2 is a side elevational view of the blank of FIG. 1 formed into a cylinder.

The second step in the manufacturing process is shown in FIG. 2 and finds the blank 20 formed into a horizontal, cylindrical, tubular configuration, the axis of the cylindrical tube extending parallel to the longitudinal strips 24 and tabs 26.

Figure 3:
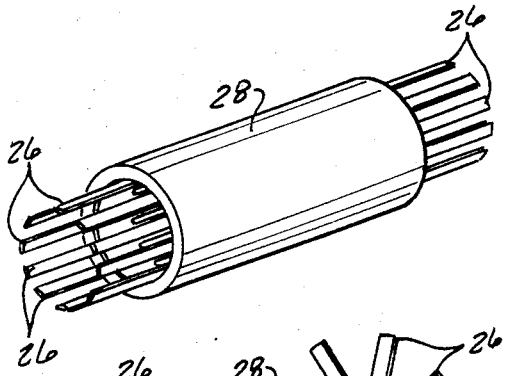
FIG. 3 is a perspective view showing a closefitting cylindrical sleeve received upon the blank of FIG. 2.

After the blank 20 is formed into the cylindrical tubing configuration of FIG. 2, a close-fitting cylindrical sleeve 28 is slipped over the tube as shown in FIG. 3, the axial length of sleeve 28 being sufficient to extend over both of transverse webs 22 leaving the tabs 26 projecting outwardly from the opposite ends of sleeve 28.

Figure 4:
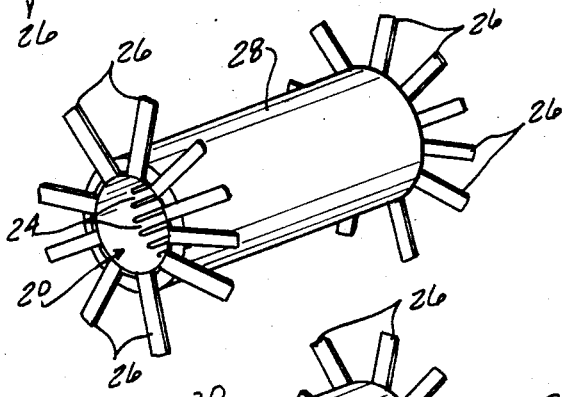
FIG. 4 is a perspective view of a subsequent step in the construction of the barrel terminal.

In the next step, the projecting tabs 26 are flared or bent outwardly across the end edges of sleeve 28 to project radially outwardly of the axis of the sleeve as shown in FIG. 4.

Figure 5:
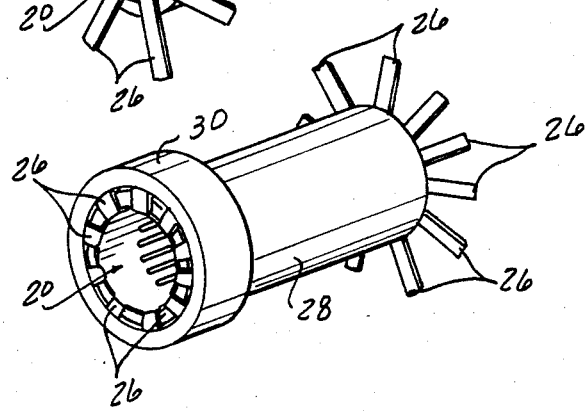
FIG. 5 is a perspective view showing the assembly after a subsequent step in the construction.

In the next step of the process, an annular ring 30 (FIG. 5) is axially driven over one end of sleeve 28, the ring bending the tabs 26 at that end of the sleeve inwardly into overlapping, face-to-face relationship with the outer surface of sleeve 28. The inner diameter of ring 30 is chosen to be such that when the ring 30 is seated in the position shown in FIG. 5, it exerts a tight-press fit which firmly and fixedly clamps the tabs 26 against the outer surface of sleeve 28 and fixedly secures that end of the blank 20 adjacent to ring 30 against any axial or rotary movement relative to sleeve 28.

In the next step illustrated in FIG. 6, a hollow tubular tool 32 having uniformly spaced, axially projecting teeth 34 at one end is engaged with the radially projecting tabs 26 at the right-hand end of the assembly as viewed in FIG. 6. The internal diameter of tool 32 is such that it will have a loose, sliding slip fit with the outer diameter of sleeve 28 and the teeth 34 are so spaced from each other as to project through the spaces between the adjacent, radially projecting tabs 26.

When tool 32 is seated with its teeth 34 between the radially projecting tabs 26, sleeve 28 is clamped or held against rotation and tool 32 is rotated coaxially of sleeve 28 through a predetermined angle, which typically is 15 to 20 degrees. This action of the tool rotatively offsets that end of the blank 20 from the previously fixed end held against rotation relative to the sleeve 28 by the ring 30. The characteristics of the beryllium copper alloy of which the blank 20 is made up are such that although the material possesses some resiliency, the rotation imparted by tool 32 permanently sets the blank in the rotated position.

Prior to this rotation of one end of the blank relative to the other, the longitudinal strips 24 of the blank extended parallel to the axis of sleeve 28. While the individual strips 24 still extend along straight lines after the rotary offsetting step illustrated in FIG. 6 takes place, the strips no longer lie on a cylindrical surface, but now define an hourglass shaped internal envelope within cylindrical sleeve 28. The schematic diagrams of FIGS. 9 and 10 illustrate the end result achieved by the rotary offsetting step of FIG. 6.

FIGS. 9 and 10 are simplified schematic diagrams in which displacements have been somewhat exaggerated to more clearly illustrate the end result. FIG. 9 is an end view of a schematic representation of the strips 24 with sleeve 28 indicated in broken line, while FIG. 10 is a side elevational view. In FIGS. 9 and 10, individual strips 24 are represented by straight lines such as 12A–2B; A and B representing imaginary circles containing the points at which the ends of the respective strips are attached to the webs 22. For purposes of explanation, FIGS. 9 and 10 indicate an arrangement in which 12 individual strips are connected to points on circle A spaced 30 degrees from each other, similar to spacing between the hour positions on a clock dial, indicated at reference numerals 1 through 12 in FIG. 9. The rotary offsetting produced by operation of the tool 32 in FIG. 6 is, in FIGS. 9 and 10, assumed to be 60 degrees so that a strip represented by the line 12A–2B is connected at one end to the twelve o'clock position 12 on circle A and to the two o'clock position 2 on circle B. Because the strips extend in a straight line between their opposite ends, they do not lie against the inner surface of cylindrical sleeve 28, but instead, as best seen in FIG. 9, when viewed axially appear to constitute a cord, these cords being tangent to a circle of reduced radius as compared to the radius of the circle to which the respective strips have their ends connected. As best seen in the side view of FIG. 10, this results in an approximation of a generally hourglass shaped internal passage which is cooperatively defined by the inner surfaces of the strips 24 after the strips have been rotatively offset.

Returning now to FIG. 6, after the rotational offset performed by the tool 32 is completed, a second annular ring 36 is force fitted onto sleeve 28 to fixedly clamp the tabs 26 against the outer surface of sleeve 28, as previously described in connection with the seating of the ring 30.

The completed barrel socket is shown in FIG. 7. FIG. 8 shows a typical barrel socket connector arrangement with the unit as shown in FIG. 7 seated within a suitable housing 40 which will be mechanically mounted in an electrically conductive relationship with one portion of an electric circuit, as by a threaded stud 42. The mating element of the connector takes the form of a cylindrical prong 44 whose diameter is slightly less than the internal diameter of the transverse webs 24 when seated in sleeve 28, and somewhat greater than the minimum radius of the envelope defined by the rotatively offset longitudinal strips 24 described above with reference to FIGS. 9 and 10. This envelope is indicated at E in FIG. 8. When the prong 44 is fully inserted into sleeve 28, it requires the individual strips 24 to stretch longitudinally somewhat so that the strips can be moved radially outwardly toward the inner surface of sleeve 28 a sufficient distance to accommodate the insertion of prong 44. The inner surfaces of the strips, particularly midway of their ends, thus lie tightly against the outer surface of prong 44 to maintain a firm frictional grip on the prong sufficient to mechanically maintain the connection in the face of normally encountered forces. However, the grip is not so tight as to prohibit manual withdrawal of the prong from the socket.

As an example of typical dimensions, referring to FIG. 7, the barrel socket there shown may have a length of approximately one inch and an internal diameter of sleeve 28 of approximately one-half an inch. With those dimensions, a rotary offset of one end of the blank relative to the other of approximately 15 to 20 degrees will produce a reduction in the radius between the midpoints of longitudinal strips 24 of about 30 to 40 one-thousandths of an inch.

While one embodiment of the invention has been described in detail, it will be apparent to those skilled in the art that the disclosed embodiment may be modified. Therefore, the foregoing description is to be considered exemplary rather than limiting, and the true scope of the invention is that defined in the following claims.

We claim:

1. The method of making a barrel terminal comprising the steps of:

A. forming a flat rectangular sheet metal blank with a plurality of uniformly spaced, parallel, longitudinal strips integrally joined at their opposite ends to a pair of spaced, parallel connecting webs extending continuously transversely across said blank in inwardly spaced, parallel relationship to the opposed end edges of said blank and a plurality of spaced, longitudinally extending tabs projecting outwardly from each connecting web to the opposed end edges of the blank, B. forming said blank into a cylinder having a longitudinal axis parallel to said longitudinal strips, C. inserting the cylindrical blank into a close-fitting cylindrical sleeve having an axial length substantially equal to the distance between the outer edges of said webs.

D. flaring the tabs at both ends of said blank outwardly across the opposite ends of said sleeve to positions projecting radially ouwardly from the axis of said sleeve, E. bending the tabs at one end of said cylindrical blank into face-to-face engagement with the outer surface of said sleeve and fixedly securing said one end of said blank to said sleeve, F. rotating the opposite end of said blank about its longitudinal axis through a predetermined angle relative to said sleeve, and G. bending the tabs at said other end of said cylindrical blank into face-to-face engagement with the outer surface of said sleeve and fixedly securing said opposite end of said blank to said sleeve with said opposite end rotatively displaced from said one end by said predetermined angle.

2. The invention defined in claim 1 wherein the steps (E and G) of bending the tabs against the outer surface of the sleeve and fixedly securing the ends of the blank to said sleeve comprise the step of force fitting an annular ring coaxially on said sleeve in overlying relationship to said tabs by axially advancing said ring against said radially projecting tabs.

3. The invention defined in claim 1 wherein the step (F) of rotating the opposite end of said blank relative to said sleeve comprises the steps of axially inserting axially projecting fingers on a tool between the radially projecting tabs at said one end of said blank, and rotating said tool about said axis through an angle of about 15 to 20 degrees.

4. A barrel terminal comprising a cylindrical sleeve and a contactor member coaxially received within said sleeve, said contactor member comprising a one-piece member of sheet material including a pair of like, axially spaced coaxial annular web sections of uniform and equal diameter fixedly seated against the inner surface of said sleeve, a plurality of like elongate connector strips integrally joined at one end to one of said web sections an integrally joined at its opposite end to the other of said web sections, said strips being joined to said web sections at uniformly spaced intervals about the respective circumferences of the web sections, the location at which each strip is joined to said one of said web sections being angularly displaced about the common axis of said band sections from the location at which the strip is joined to the other of said web sections and the strip extending along a straight line from one web section to the other.

5. The invention defined in claim 4 further comprising a plurality of mounting tabs integrally joined to each web section and extending from the web section around the adjacent end edge of siad sleeve and into face-to-face engagement with the outer surface of said sleeve, and annular ring means fixedly clamping said tabs into face-to-face engagement with the outer surface of said sleeve.

* * * * *

UNITED STATES PATENT OFFICE

CERTIFICATE OF CORRECTION

Patent No. 4,657,335 Dated April 14, 1987

Inventor(s) Joseph J. Koch, et al

It is certified that error appears in the above-identified patent and that said Letters Patent are hereby corrected as shown below:

In the Specification:

Column 2, line 60, after "flat", delete "shet" and insert --sheet--.

In the Claims:

Column 5, line 54, after "webs", delete "." and insert --,--.

Signed and Sealed this

Fifteenth Day of September, 1987

*Attest:*

DONALD J. QUIGG

*Attesting Officer*

*Commissioner of Patents and Trademarks*